US011673146B2

(12) United States Patent
Haslett et al.

(10) Patent No.: US 11,673,146 B2
(45) Date of Patent: Jun. 13, 2023

(54) MATERIAL WASHING SYSTEM AND APPARATUS

(71) Applicant: Terex GB Limited, Dungannon (GB)

(72) Inventors: Steven Haslett, Claudy (GB); Johnston Patterson, Moira (GB)

(73) Assignee: Terex GB Limited, Dungannon (GB)

( * ) Notice: Subject to any disclaimer, the term of this patent is extended or adjusted under 35 U.S.C. 154(b) by 0 days.

(21) Appl. No.: 17/377,679

(22) Filed: Jul. 16, 2021

(65) Prior Publication Data

US 2022/0016636 A1 Jan. 20, 2022

(30) Foreign Application Priority Data

Jul. 20, 2020 (GB) ..... 2011201

(51) Int. Cl.
*B03B 5/62* (2006.01)
*B03B 9/00* (2006.01)

(52) U.S. Cl.
CPC . *B03B 5/62* (2013.01); *B03B 9/00* (2013.01)

(58) Field of Classification Search
CPC .... B03B 5/62; B03B 9/00; B03B 5/00; B03B 5/02; B03B 5/34; B03B 7/00; B07B 2201/04; B07B 2230/01; B07B 1/55
USPC ..... 209/158
See application file for complete search history.

(56) References Cited

U.S. PATENT DOCUMENTS 2,332,183 A * 10/1943 Stump ..... B03B 4/00 209/474
5,614,094 A * 3/1997 Deister ..... B07B 1/46 210/392
9,776,214 B2 * 10/2017 Vallelly ..... B07B 9/02
10,189,028 B2 * 1/2019 Convery ..... B07B 1/005
10,399,123 B2 * 9/2019 Ivanoff ..... E21B 21/065
10,576,503 B2 * 3/2020 Amaravadi ..... E21B 21/065
2010/0089652 A1 * 4/2010 Burnett ..... B07B 13/18 209/269

(Continued)

FOREIGN PATENT DOCUMENTS

CN 101330989 A * 12/2008 ..... B07B 1/46
CN 105597916 A 5/2016

(Continued)

OTHER PUBLICATIONS

Search Report for Application GB2011201.7, dated Jan. 11, 2021, one page.

(Continued)

*Primary Examiner* — Gene O Crawford
*Assistant Examiner* — Muhammad Awais
(74) *Attorney, Agent, or Firm* — Warner Norcross + Judd LLP

(57) ABSTRACT

A washing apparatus comprises a screening apparatus having a first screening deck located below a second screening deck, wherein the first screening deck passes material that is larger than the material passed by the second screening deck. A liquid delivery system delivers liquid onto the first screening deck to wash material on the first deck. Material that passes through the first deck is conveyed upwards and delivered onto the second deck for dewatering. The apparatus is able to wash and dewater aggregate material in a single unit with a relatively small footprint and relatively high throughput.

20 Claims, 6 Drawing Sheets

(56) References Cited

U.S. PATENT DOCUMENTS

| | | | | |
|---|---|---|---|---|
| 2010/0089802 | A1* | 4/2010 | Burnett | B07B 1/46 209/660 |
| 2010/0270216 | A1* | 10/2010 | Burnett | B07B 13/16 209/606 |
| 2014/0166592 | A1* | 6/2014 | Holton | E21B 21/06 210/330 |
| 2019/0126173 | A1* | 5/2019 | Loshe | B01D 21/0042 |
| 2019/0366243 | A1* | 12/2019 | Colgrove | B07B 1/4609 |
| 2020/0030813 | A1* | 1/2020 | Lines | B03B 5/48 |

FOREIGN PATENT DOCUMENTS

| | | | | | |
|---|---|---|---|---|---|
| CN | 107096632 | A | * | 8/2017 | B02C 21/00 |
| CN | 110076079 | A | * | 8/2019 | |
| CN | 111185295 | A | * | 5/2020 | B03B 11/00 |
| CN | 111389498 | A | * | 7/2020 | |
| DE | 102013018873 | B3 | * | 11/2014 | B07B 1/485 |
| GB | 268682 | A | | 4/1927 | |
| GB | 2527078 | A | * | 12/2015 | B65G 11/02 |
| GB | 2528257 | A | * | 1/2016 | B03B 11/00 |
| GB | 2561452 | A | | 10/2018 | |
| GB | 2561452 | A | * | 10/2018 | B03B 5/00 |
| GB | 2572332 | A | * | 10/2019 | B03B 5/00 |
| WO | WO-8907989 | A1 | * | 2/1989 | |
| WO | 89/07989 | A1 | | 9/1989 | |
| WO | WO-8907989 | A1 | * | 9/1989 | B03B 5/00 |
| WO | 03/020429 | A2 | | 3/2003 | |
| WO | WO-2010102232 | A2 | * | 9/2010 | B07B 13/16 |

OTHER PUBLICATIONS

European Search report for Application EP21185302, dated Dec. 3, 2021, 8 pages.

* cited by examiner

MATERIAL WASHING SYSTEM AND APPARATUS

FIELD OF THE INVENTION

This invention relates to material washing systems and apparatus. The invention relates particularly to systems and apparatus for washing aggregate material.

BACKGROUND TO THE INVENTION

The demand for quality washed aggregate material, for example manufactured sand and marine dredged sand, is on the increase. When processing material that is required to be washed and the finer particles dewatered, typically two separate screen boxes are required. The first screen is used to separate the material into the required fractions and the second screen used to reduce the moisture content in the finer material (de-watering). Producers desire a more compact, affordable solution without compromising production rates.

A more cost effective solution to washing and de-watering is to use a single deck screen with a negative angle deck which has a central divider installed; one side of the screen is used for washing and the other for de-watering. Dry material may be received in a reception box where water is added to create slurry. The slurry is discharged onto one side of the single deck vibrating screen, where the larger particulate is washed and discharged downstream from the deck. The finer particulate and process water pass through the screen into a sump tank below. A pump transfers the sump tank slurry to a hydro cyclone where the silt and clays are removed and the cyclone underflow is discharged onto the opposite side of the vibrating screen. The underflow slurry is de-watered, the dirty water being captured by the sump below and the particulate being discharged downstream from the deck. This creates two washed products but the tonnage capacity of the machine is relatively low as only one split deck vibrating screen is used.

It would be desirable to mitigate the problems outlined above.

SUMMARY OF THE INVENTION

From a first aspect, the invention provides a washing apparatus comprising: a screening apparatus having a first screening deck configured to pass material of up to a first particle size, and a second screening deck configured to pass material of up to a second particle size; and a liquid delivery system configured to deliver liquid onto the first screening deck, wherein the second screening deck is located above the first screening deck, and wherein said first particle size is larger than said second particle size.

The apparatus may include, or may be co-operable with, means for conveying material that passes through said first screening deck to said second screening deck.

In typical embodiments, the first screening deck has a feed inlet, a discharge outlet spaced apart from said feed inlet in a longitudinal direction, and a screen located between said feed inlet and said discharge outlet, and the said second screening deck has a feed inlet, a discharge outlet spaced apart from said feed inlet in the longitudinal direction, and a screen located between said feed inlet and said discharge outlet. The first and second screening decks are preferably aligned with each other such that they overlap in the longitudinal direction and in a transverse direction that is perpendicular to the longitudinal direction.

The liquid delivery system preferably comprises at least one liquid delivery device, preferably comprising at least one spray device configured to spray liquid onto the screen of said first screening deck, and is preferably located above said screen of said first screening deck. Said at least one spray device comprises a plurality of spray devices spaced apart in said longitudinal direction between the feed inlet and the discharge outlet of the first screening deck. Said at least one spray device typically comprises a plurality of spray nozzles spaced apart in the transverse direction.

Preferably, the screen of said second screening deck is inclined upwardly from the feed inlet of said second screening deck to the discharge outlet of said second screening deck.

Optionally, said second screening deck comprises a drain at the feed inlet. The drain is preferably configured to drain liquid from said second screening deck onto said first screening deck. The drain may comprise a screen section extending upwardly from the screen of said second screening deck.

In preferred embodiments, at least one liquid-guiding channel structure is located beneath the screen of the second screening deck, said at least one liquid-guiding channel structure having at least one inlet for receiving liquid that passes through the screen of the second screening deck, and at least one outlet for delivering liquid to the first screening deck. Said at least one liquid-guiding channel structure is preferably configured to guide liquid towards the feed inlet of said second screening deck, and wherein, preferably, said at least one outlet is located above the feed inlet of the first screening deck. Said at least one liquid-guiding channel structure is preferably inclined downwards in a direction from the discharge outlet of said second screening deck to the feed inlet of said second screening deck. In preferred embodiments, said at least one liquid-guiding channel structure comprises a tray.

Optionally, the apparatus includes a liquid delivery system configured to direct liquid onto said at least one channel structure to flush material towards said at least one outlet.

Optionally, a dam is provided at the discharge outlet of the second screening deck.

In typical embodiments, the apparatus includes a vibratory drive system coupled to said screening apparatus for imparting vibratory movement to said first and second screening decks. The vibratory drive system is preferably configured to impart vibratory movement to said first and second screening decks that moves material on the respective screens in a direction from the respective feed inlet to the respective discharge outlet.

From another aspect, the washing system comprising a washing apparatus according to the first aspect of the invention, the washing system further comprising means for conveying material that passes through said first screening deck to said second screening deck.

Typically, the washing system includes a sump, preferably located beneath said first screening deck, for receiving material that passes through the first screening deck, wherein said conveying means is configured to convey material from said sump.

The conveying means typically comprises a pump system comprising at least one pump and at least one conduit.

Optionally, the conveying means includes a liquid-solid separating device, preferably comprising one or more hydrocyclone.

Typically, the washing system includes feeding means, typically comprising a feed receptacle or other feeder, arranged to feed material to the first screening deck.

Typically, the washing system includes a respective output apparatus for receiving material from the first and second screening decks, wherein each output apparatus may comprise a chute and/or a conveyor.

Preferred embodiments provide a washing system for washing and dewatering aggregate material with a relatively small footprint and relatively high throughput. Advantageously, the preferred washing apparatus is capable of rinsing and dewatering material in a single unit. The preferred apparatus has a screening apparatus with at least two decks, wherein an upper deck is used for de-watering and a lower deck is used for rinsing.

Other advantageous aspects of the invention will become apparent to those ordinarily skilled in the art upon review of the following description of a specific embodiment and with reference to the accompanying drawings.

BRIEF DESCRIPTION OF THE DRAWINGS

An embodiment of the invention is now described by way of example and with reference to the accompanying drawings in which.

DETAILED DESCRIPTION OF THE DRAWINGS

Figure 1:
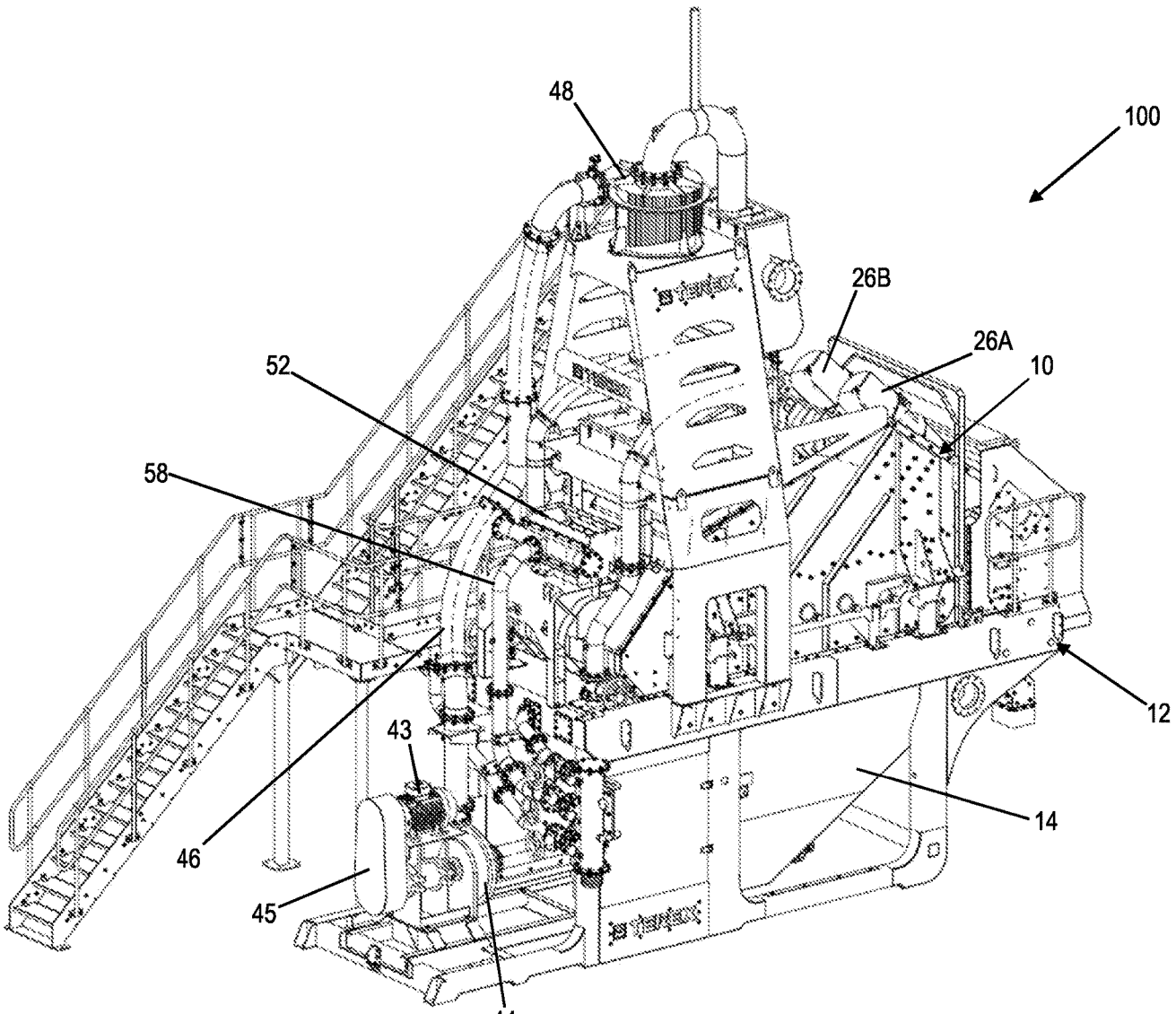
FIG. 1 is a perspective view of a washing system embodying one aspect of the invention, and including a washing apparatus embodying another aspect of the invention.
Figure 2:
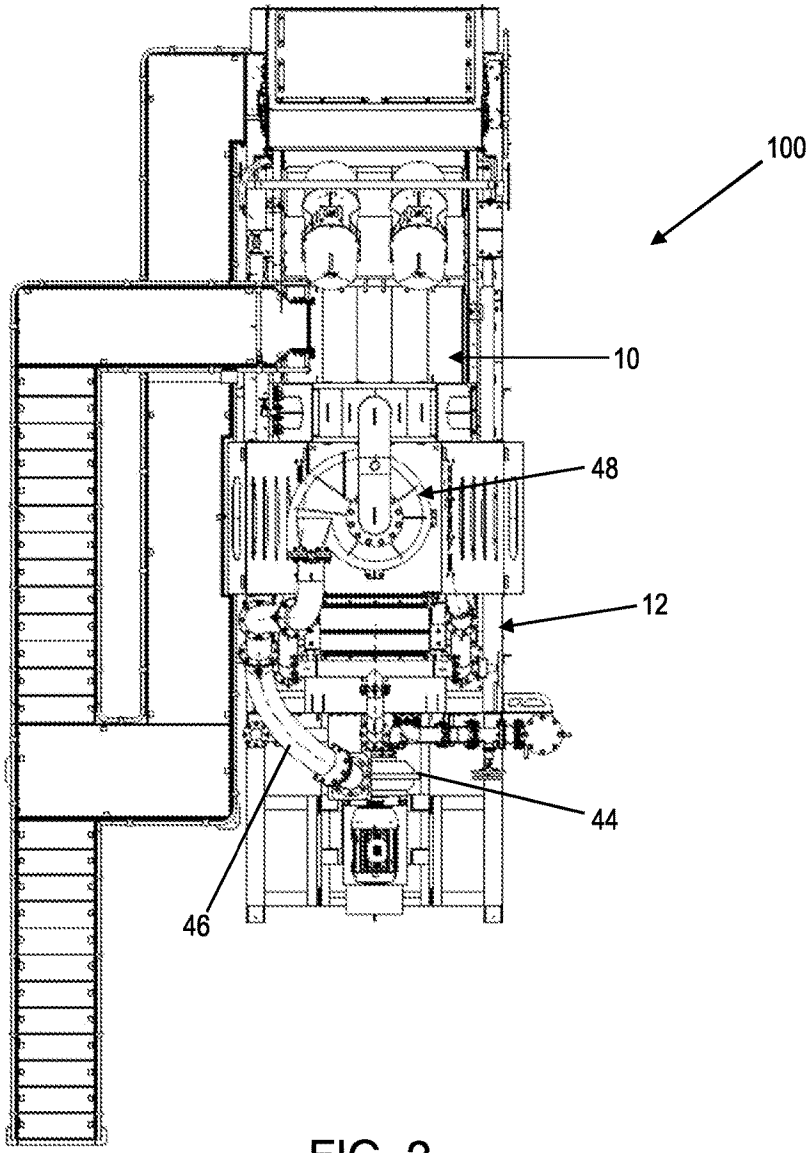
FIG. 2 is a plan view of the washing system of FIG. 1.
Figure 3:
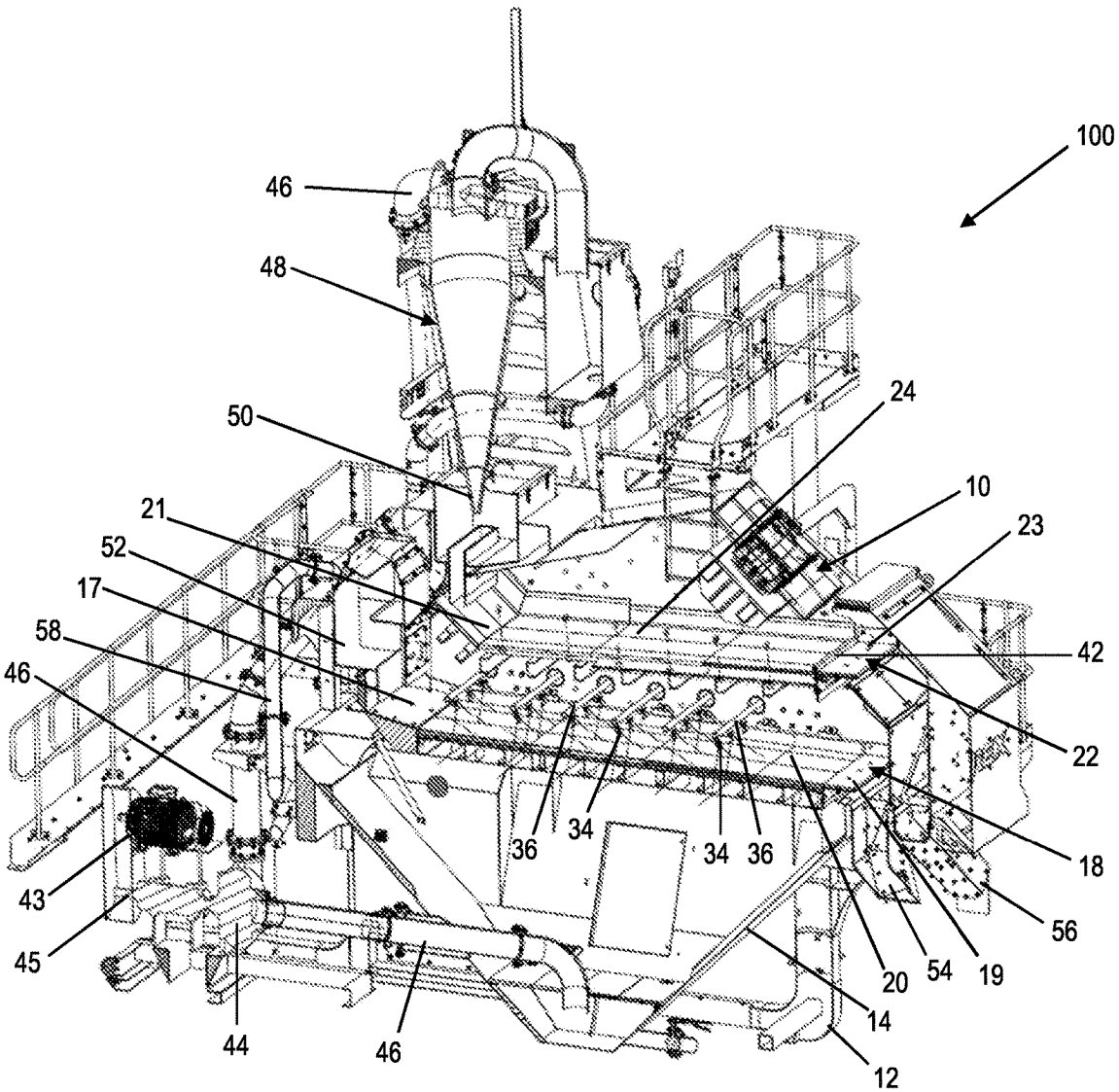
FIG. 3 is a cut-away perspective view of the washing system of FIG. 1.
Figure 4:
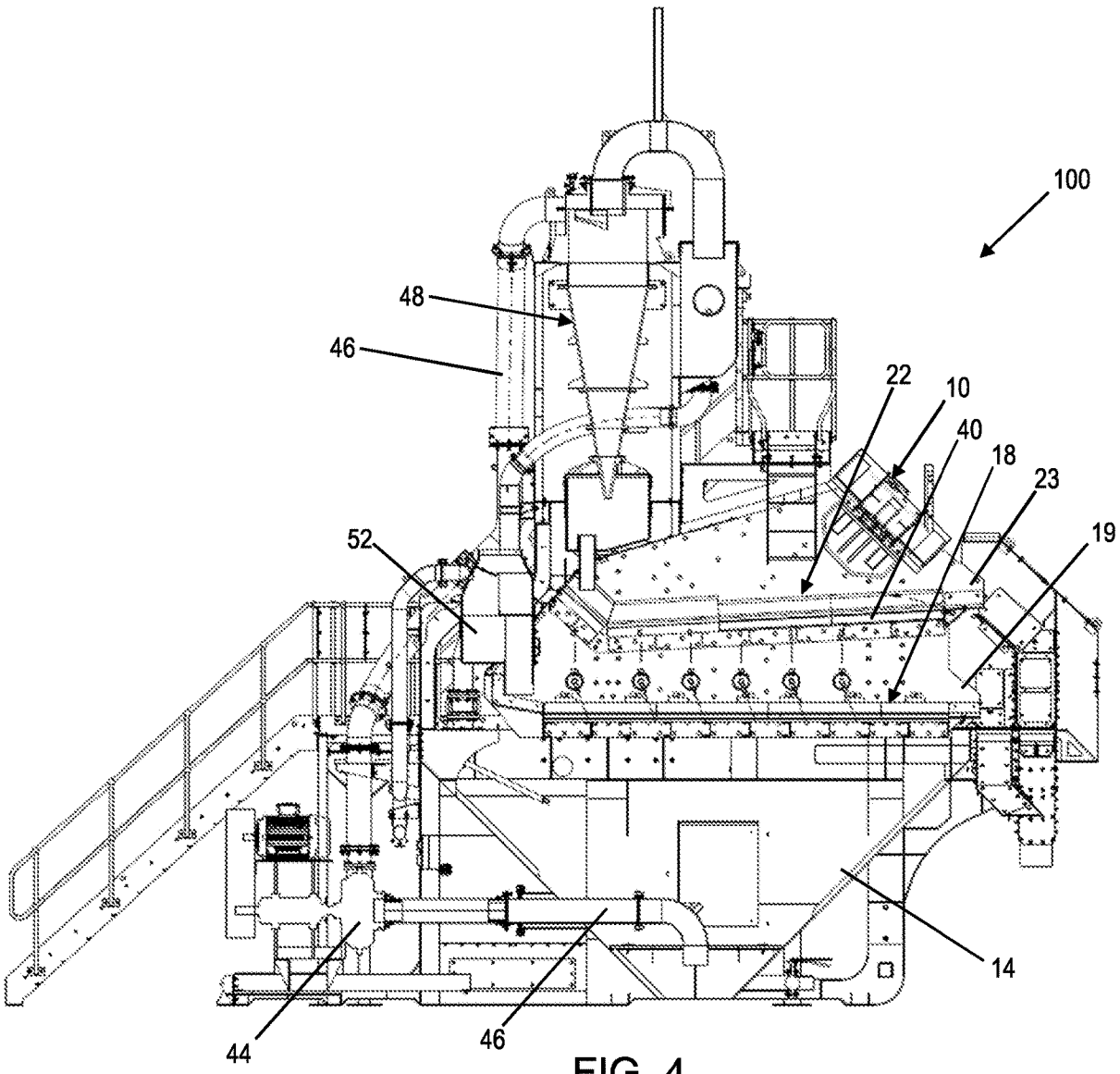
FIG. 4 is a cut-away side view of the washing system of FIG. 1.
Figure 5:
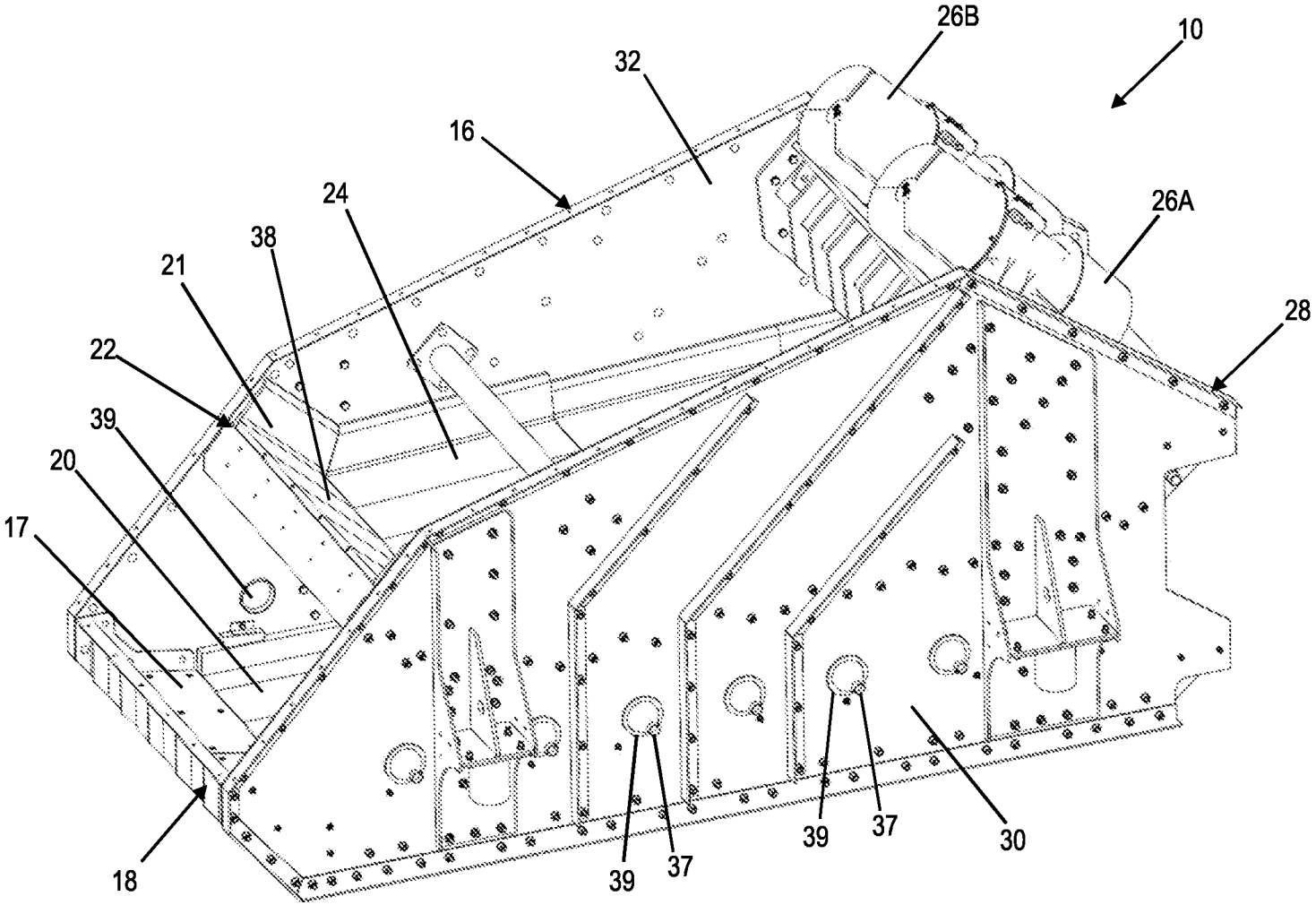
FIG. 5 is a perspective view of the washing apparatus included in the washing system of FIG. 1.
Figure 6:
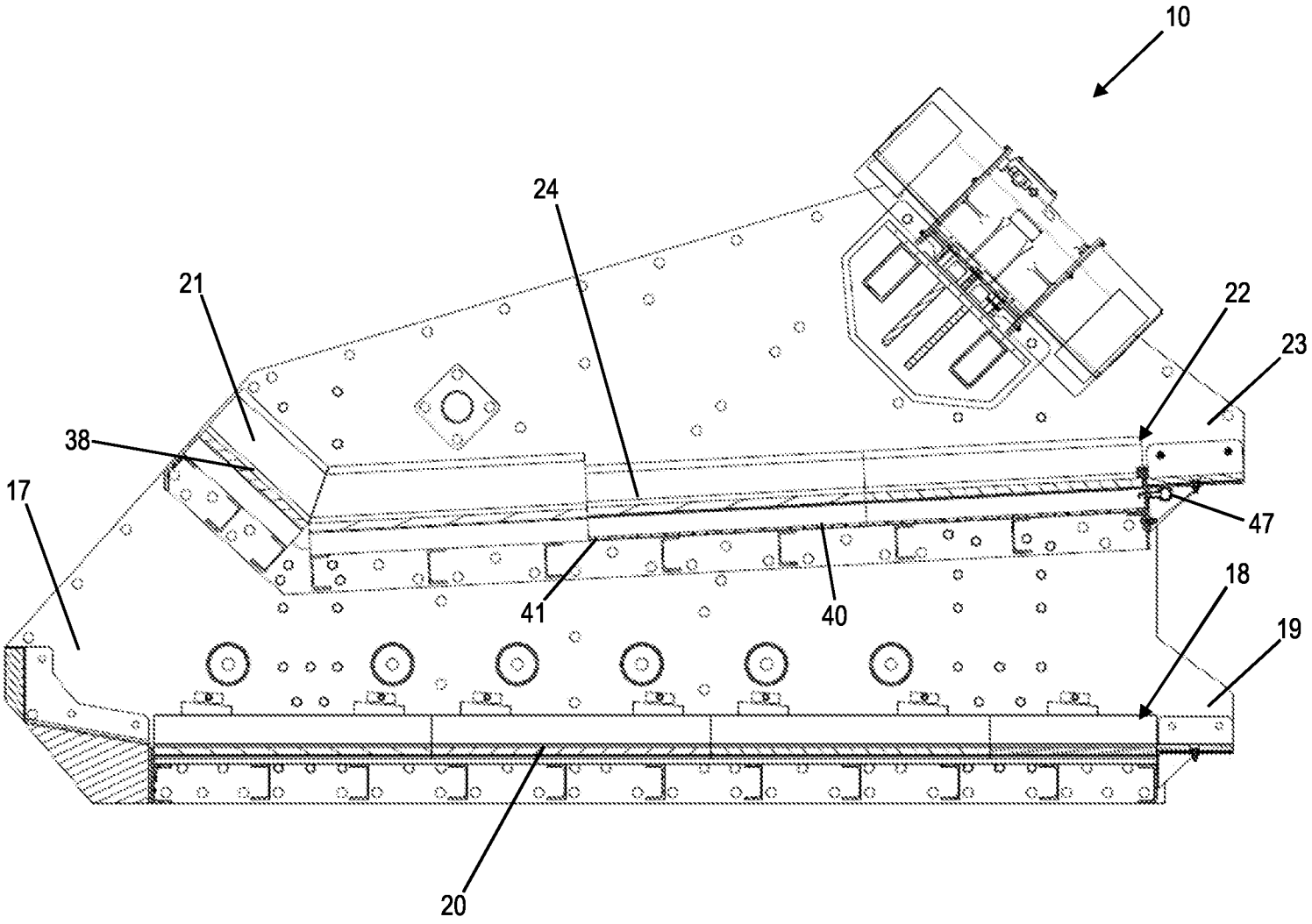
FIG. 6 is a cut-away side view of the washing apparatus of FIG. 5.

Referring now to the drawings there is shown, generally indicated as 10, a washing system embodying one aspect of the invention. The apparatus 10 is particularly suited for use in washing aggregate material that comprises different sizes of particulate material, for example rocks or stones, and which is contaminated with other material such as silt or clay. While embodiments of the invention are particularly suited for washing rocks or stones, they may alternatively be used for washing other material, for example sand, gravel, slag, or earth.

The washing system 100 comprises a washing apparatus 10 embodying another aspect of the invention. The system 100 includes a support structure 12 for supporting the washing apparatus 10 and other components of the system 100 as required. The support structure 12 may take any suitable conventional form, typically being configured to support the washing apparatus 100 above ground level to provide space beneath the washing apparatus 10 for a sump 14 as is described in more detail hereinafter.

Typically, the feedstock to be washed by the apparatus 10 comprises aggregate material, such as sand, comprising particles of different sizes, or grades, and the apparatus 10 is configured not only to wash the material but also to separate the material according to particle size. Accordingly, the washing apparatus 10 comprises a screening apparatus 16 having a first screening deck 18 that is configured such that material of size up to a first particle size threshold passes through it and larger particles of material do not pass through; and a second screening deck 22 configured such that material of size up to a second particle size threshold pass though it and larger particles of material do not pass through. The second screening deck 22 is located above the first screening deck 18. In preferred embodiments, the second screening deck 22 is located directly above the first screening deck, i.e. such that they are in register with, or substantially in register with, each other in a vertical direction. In alternative embodiments (not illustrated), the screening decks 18, 22 are at least partially overlapping with each other in the vertical direction.

The first screening deck 18 is configured to pass particulate material that is larger than the particulate material that the second deck 22 is configured to pass, i.e. the first particle size is larger than the second particle size. Hence, particulate material that is small enough to pass through the second screening deck 22 is also small enough to pass through the first screening deck 18, but material that passes through the first screening deck 18 is not necessarily small enough to pass through the second screening deck 22.

The first screening deck 18 has a feed inlet 17, a discharge outlet 19 spaced apart from the feed inlet 17 in a longitudinal direction, and a screen 20 located between the feed inlet 17 and the discharge outlet 19. The second screening deck 22 has a feed inlet 21, a discharge outlet 23 spaced apart from the feed inlet 21 in a longitudinal direction, and a screen 24 located between the feed inlet 21 and the discharge outlet 23.

In preferred embodiments, the decks 18, 22 are aligned with each other such that the respective longitudinal directions are parallel. The preferred arrangement is such that feed-to-discharge direction of each deck 18, 22 is the same, preferably with the respective feed inlets 17, 21 being aligned, or substantially aligned, with each other, and the respective discharge outlets 19, 23 being aligned, or substantially aligned, with each other. More generally, the first and second screening decks 18, 22 are aligned with each other such that they overlap with each other, and are preferably in register with each other, in the longitudinal direction and in a transverse direction that is perpendicular to the longitudinal direction. Preferably, the first and second decks 18, 22 are the same or a similar size.

The screens 20, 24 may take any conventional form, for example comprising screening mesh, screening bars, screening cloth, screening plate (with apertures) or any other material screening means. The screens 20, 24 include gaps or apertures, the size of which determines the size of particles that can pass through the screen 20, 24. In use, material is deposited at the feed inlet 17, 21 and particles that are below the relevant size pass through the screen 20, 24 while larger particles are conveyed to the discharge outlet 19, 23. To facilitate this process, the screens 20, 24 are usually vibrated. The screening apparatus 16 may include any conventional vibratory drive system for vibrating the screens 20, 24. For example, in the illustrated embodiment first and second out-of-balance (or unbalance) motors 26A, 26B are provided for vibrating the screens 20, 24, although one or more other conventional vibratory drives may alternatively be used. Advantageously, the vibratory drive system is operated to impart vibrations to the screens 20, 24 in a manner that causes movement of particulate material along the screens 20, 24 in a direction from the feed inlet 17, 21 to the discharge outlet 19, 23.

Typically, the screening apparatus 16 comprises a support structure 28 for supporting the screening decks 18, 22. The support structure 28 may take any suitable form but usually comprises spaced apart side walls 30, 32 between which the screening decks 18, 22 are located. The vibratory drive system 26A, 26B is mounted on the support structure 28 in order to impart vibratory movement to the screens 20, 24 via the support structure 28. Conveniently, the vibratory drive system 26A, 26B is mounted on a bridge structure 35 that extends between the walls 30, 32.

The washing apparatus 10 includes a liquid delivery system comprising at least one liquid delivery device for spraying, pouring, immersing or otherwise delivering a washing liquid, typically water, for washing received material. In preferred embodiments, the liquid delivery device(s) are arranged to wash material on the first screening deck 18. Typically, the liquid delivery device(s) comprise at least one spray device 34 configured to spray liquid onto the first screening deck 18, in particular onto the screen 20. In preferred embodiments, the liquid rinses the material that is located on the screen 20.

In preferred embodiments, a plurality of spaced apart spray devices 34, each of which may for example comprise a nozzle or spray head, are provided, preferably in a distributed arrangement along the length of, and/or across the breadth of, the screen 20. The spray devices 34 are preferably located above the screen 20 and are arranged to direct water onto the screen 20. The spray devices 34 may be supported by the support structure 28, for example being mounted on the walls 30, 32. In the illustrated embodiment, the spray devices 34 are supported by a support structure (not shown) that is external of the walls 30, 32, and which may be part of the support structure 12. The spray devices 24 are typically provided on one or more crossbar 36 that extends between the walls 30, 32. In the preferred embodiment, a plurality of crossbars 36 are provided spaced apart in the longitudinal direction, each crossbar 36 carrying a plurality of spray devices 34 spaced apart in the transverse direction. In the illustrated embodiment, the crossbars 36 are supported by an external support structure and pass through apertures 39 formed in side walls 30, 32, the apertures 39 preferably being provided with seal 37 though which the crossbars 36 pass.

The liquid delivery system is connectable to a water supply (or other liquid supply as applicable) by any convenient arrangement of pipe(s), conduit(s) and/or manifold(s) (not shown) in order to deliver liquid to the spray heads 34. For example, in the illustrated embodiment, each crossbar 36 comprises or carries one or more conduit for receiving the washing liquid and delivering the liquid to each of its spray devices 34. The conduit(s) may be connected to the water supply (which is typically external to the system 100) by a manifold (not shown) or other arrangement of pipe(s)/conduit(s).

Optionally, a liquid delivery system, which may be the same or similar to the liquid delivery system described above, is provided for the second deck 22 to deliver liquid onto the screen 24.

In preferred embodiments, the screen 24 of the second screening deck 22 is inclined upwardly from the feed inlet 21 to the discharge outlet 23. This inclination causes liquid (including small particles suspended in the liquid) that is present on the screen 24 to run under the influence of gravity towards the feed inlet 21. Preferably, a drain 38 is provided at the feed inlet 21. The drain 38 may be configured to drain liquid from the second screening deck 22 onto the first screening deck 18, preferably onto the screen 20, preferably at or adjacent the feed inlet 17. To this end, the drain 38 may be located above the screen 20, preferably in line with the feed inlet 17. The drain 38 may comprise a screen section that extends upwardly from the screen 24. In use, liquid (which typically includes relatively fine particulate material) that is present in the material deposited on the second screen deck 22 may drain through the screen 24 itself, or through the drain 38. This results in de-watering of the particulate material that does not pass through the screen 24 and which is delivered to the discharge outlet 23.

In preferred embodiments, at least one liquid-guiding channel structure 40 is located beneath the screen 24. The channel structure 40 is shaped to define at least one channel and is arranged to receive material that passes through the screen 24. In preferred embodiments, the screen 24 is configured to pass only relatively fine particulate material and so the material received by the channel structure 40 typically comprises liquid in which fine particulates, e.g. silt or clay, are suspended. The channel structure 40 is preferably arranged to deposit the liquid onto the first screening deck 18, preferably onto the screen 20, preferably at or adjacent the feed inlet 17. To this end, the channel structure 40 has an outlet 41 located above the screen 20. The channel structure 40 has at least one inlet for receiving the liquid that passes through the screen 24. In preferred embodiments, the channel 40 is provided by one or more open-topped structure, preferably a tray, and is shaped and dimensioned to receive the liquid from the screen 24 via the open top. Preferably, the channel structure 40 is inclined downwards in a direction from the discharge outlet 23 to the feed inlet 21. Optionally, the channel structure 40 is parallelly disposed with respect to the screen 24. The channel structure 40 may be mounted on the screen 24 or on the support structure 28, or elsewhere as is convenient.

Optionally, at least one liquid delivery device 47 for spraying, pouring or otherwise delivering liquid, typically water, onto the channel structure 40 is provided and is configured to flush material received by the channel structure 40 towards the outlet 41. Conveniently the liquid delivery device(s) 47 are located at an end of the channel structure 40 opposite the outlet 41 and arranged to direct water at material in the channel during use. Typically, the or each device 47 comprises a spray device, e.g. a spray head or nozzle.

In preferred embodiments, a dam 42 is provided at the discharge outlet 23 of the second screening deck 22. The dam 42 helps to prevent liquid from being discharged from the discharge outlet 23 and so aids the de-watering process.

The washing apparatus 10 may include, or may be connected to or otherwise co-operable with, means for conveying material that passes through the screen 20 of the first screening deck 18 to the screen 24 of the second screening deck 22. In preferred embodiments, the conveying means is part of the washing system 100. The conveying means typically comprises a pump system comprising at least one pump 44 and one or more conduits 46. The pump system may include one or more motor 43 for driving the pump(s) 44, either directly, or indirectly via a drivetrain 45, as suits the application. Optionally, the conveying means includes a hyrdrocyclone 48, or one or more other separating device, e.g. filter(s) and/or sand separator(s), for removing at least some liquid and typically also unwanted finer particles from the material being transferred to the second deck 22.

In preferred embodiments, the sump 14 is located beneath the first screen deck 18 and receives material that passes through the screen 20. The sump 14 may be open-topped defining an open mouth that is positioned below the screen 20 and is shaped and dimensioned to collect material that passes through the screen 20. To this end the size of the mouth may be at least as big as the underside of the screen 20. Alternatively, material may be directed to the sump 14 from the first deck 18 via one or more conduits, in which case it is not essential to locate the sump 14 beneath the screen deck 18 although this is preferred as it minimizes the footprint of the system 100. The conveying means 44, 46 is configured to convey material from the sump 14 to the second screen deck 22. In preferred embodiments, the pump 44 is located outside of the sump 14 and is operable to draw material from the sump 14. Alternatively, the pump 44 may be a submersible pump located in the sump 14.

The conveying means 44, 46 is preferably configured to deliver material to the feed inlet 21 of the second screen deck 22. In the preferred embodiment, as illustrated, the hydrocyclone 48 is located at the delivery end of the conveying means. In such cases, the underflow outlet 50 of the hydrocyclone 48 is positioned over the feed inlet 21 of the second deck 22 in order that the larger particulate material output by the hydrocyclone 48 is fed to the screen 24. Alternatively, a conduit may be provided for directing the underflow output of the hydrocyclone 48 to the feed inlet 21. Alternatively still, in embodiments where the hydrocyclone 48 is omitted, the conduit 46 may be configured to deliver material directly to the feed inlet 21 of the second screen deck 22.

The washing system 100 includes or is co-operable with feeding means for feeding (unwashed) material to the first screening deck 18, in particular to the feed inlet 17. The feeding means typically comprises a feed receptacle 52, which may be referred to as a feed box or feeder, arranged to feed material to the first screening deck 18, in particular to the feed inlet 17. Alternatively, or in addition, the feeding means may comprise a conveyor (not shown).

The washing system 100 may include a respective output apparatus for receiving material from the first and second screening decks 18, 22, in particular from their respective discharge outlet 19, 23. For example, the system 100 includes a respective chute 54, 56 configured to receive material from the respective discharge outlet 19, 23. Each chute 54, 56 may direct the material to another apparatus (not shown), e.g. a conveyor, or to a stockpile, or any other desired location depending on the requirements of the application.

The support structure 12 may be configured to support any one or more of the sump 14, pump 44, conduit 46, hydrocyclone 48, feed receptacle 52 and chutes 54, 56 as desired. Optionally, steps and walkways may be provided as needed.

In use, unwashed aggregate material is deposited in the feed receptacle 52. The material may comprise dry particulate material. Preferably, water or other liquid is added to the aggregate material to render it to a slurry. The liquid may be added to the aggregate material while it is in the feed receptacle 52. This may be achieved by any convenient means but in the illustrated embodiment a liquid inlet pipe 58 is connected to the feed receptacle 52 and may be connected to an external water source. Alternatively, the aggregate material may be provided to the receptacle 52 in slurry form.

The aggregate material is fed to the feed input 17 of the first screen deck 18 from the receptacle 52 and onto the screen 20. The vibratory movement of the screen 20 causes the material to move along the screen 20 towards the discharge outlet 19. The spray devices 34 spray water onto the material on the screen 20 thereby rinsing it. Liquid (from the slurry and from the spray devices 34) together with particulate material that is small enough to pass through the screen 20 passes through the screen 20 and is collected in the sump 14. Larger particulate material is conveyed along the screen 20 to the discharge outlet 19 whereupon it may be discharged via chute 54 (having been washed by the action of the spray devices 34).

The pump system pumps material (containing liquid and relatively fine particulate material in slurry form) from the sump 14 through the conduit 16 and delivers it to the inlet of the hydrocyclone 48. The hydrocyclone 48 separates the larger particles of the received particulate material from the smaller particles and from most of the liquid, and delivers the larger particles (typically with some liquid) to the feed inlet 21 of the second screen deck 22 and thus onto the screen 24. The vibratory movement of the screen 24 causes the material to move along the screen 24 towards the discharge outlet 23. Liquid and particulate material that is small enough to pass through the screen 24 passes through the screen 24 and is collected in the tray 40. Larger particulate material is conveyed along the screen 24 to the discharge outlet 23 whereupon it may be discharged via chute 56 (having been de-watered by the action of the screen 24 and previously rinsed by the spray devices 34).

The material collected by the tray 40 is directed onto the first deck 18 whereupon it passes through the screen 20 and into the sump 14. Liquid and relatively fine particulate material that passes through the drain 38 is also directed onto the first deck 18 whereupon it passes through the screen 20 and into the sump 14. When the washing process is finished, any slurry remaining in the sump 14 may be drained or otherwise removed from the sump 14 in any conventional manner.

It will be apparent from the foregoing the washing system 100 and washing apparatus 10 produce a first grade of relatively large, washed particulate material from the discharge outlet 19 of the first screen deck 18, and a second grade of smaller, washed and de-watered particulate material from the discharge outlet 23 of the second screen deck 22. For example, in typical embodiments, the aggregate material provided to the feed receptacle 52 comprises particles with a size (e.g. width, length or diameter as applicable) of up to 40 mm. the first grade of material may comprise particles of between 6 mm and 40 mm and the second grade may comprise particles of up to 6 mm. It will be understood that these dimensions are not limiting and may vary from application to application.

The system 100 and apparatus 10 have an improved throughput in comparison with conventional split deck solutions since first and second full screen decks 18, 22 are used for washing and de-watering. Moreover, the system 100 and apparatus 10 have a relatively small footprint, particular in comparison to conventional alternative solutions that use separate washing and de-watering machines, because the first and second decks 18, 22 are stacked on top of each other. This creates two sealable products but with an increased tonnage due to the utilization of two compete decks rather than using one split deck.

In alternative embodiments (not illustrated) the washing apparatus 10 may have more than two screening decks. For example, a third screening deck may be located between the first and second screening decks 18, 22, the third screening deck being configured to pass material having a maximum particle size that is smaller than said second particle size.

The invention is not limited to the embodiment(s) described herein but can be amended or modified without departing from the scope of the present invention.

The invention claimed is:

1. A washing apparatus for washing particulate material, the apparatus comprising:

a screening apparatus having a first screening deck configured to pass material of up to a first particle size, and a second screening deck configured to pass material of up to a second particle size; and a liquid delivery system configured to deliver liquid onto the first screening deck, wherein the second screening deck is located directly above the first screening deck or above and at least partially overlapping with the first screening deck, and wherein said first particle size is larger than said second particle size, such that said first screening deck is configured to pass material larger than said second particle size, and wherein the washing apparatus includes or is co-operable with means for conveying material that passes through said first screening deck to said second screening deck.

2. The washing apparatus of claim 1, wherein said first screening deck has a feed inlet, a discharge outlet spaced apart from said feed inlet in a longitudinal direction, and a screen located between said feed inlet and said discharge outlet, and wherein said second screening deck has a feed inlet, a discharge outlet spaced apart from said feed inlet in the longitudinal direction, and a screen located between said feed inlet and said discharge outlet.

3. The washing apparatus of claim 2, wherein said first and second screening decks are aligned with each other such that they overlap in the longitudinal direction and in a transverse direction that is perpendicular to the longitudinal direction.

4. The washing apparatus of claim 2, wherein said liquid delivery system comprises at least one spray device configured to spray liquid onto the screen of said first screening deck.

5. The washing apparatus of claim 4, wherein said at least one spray device comprises a plurality of spray devices spaced apart in said longitudinal direction between the feed inlet and the discharge outlet of the first screening deck.

6. The washing apparatus of claim 2, wherein said at least one spray device comprises a plurality of spray nozzles spaced apart in the transverse direction.

7. The washing apparatus of claim 2, wherein the screen of said second screening deck is inclined upwardly from the feed inlet of said second screening deck to the discharge outlet of said second screening deck.

8. The washing apparatus of claim 2, wherein said second screening deck comprises a drain at the feed inlet.

9. The washing apparatus of claim 8, wherein said drain is configured to drain liquid from said second screening deck onto said first screening deck.

10. The washing apparatus of claim 8, wherein said drain comprises a screen section extending upwardly from the screen of said second screening deck.

11. The washing apparatus of claim 2, wherein at least one liquid-guiding channel structure is located beneath the screen of the second screening deck, said at least one liquid-guiding channel structure having at least one inlet for receiving liquid that passes through the screen of the second screening deck, and at least one outlet for delivering liquid to the first screening deck.

12. The washing apparatus of claim 11, wherein said at least one liquid-guiding channel structure is configured to guide liquid towards the feed inlet of said second screening deck.

13. The washing apparatus as claimed in claim 11, wherein said at least one liquid-guiding channel structure is inclined downwards in a direction from the discharge outlet of said second screening deck to the feed inlet of said second screening deck.

14. The washing apparatus of claim 11, wherein said at least one liquid-guiding channel structure comprises a tray.

15. The washing apparatus of claim 11, including a liquid delivery system configured to direct liquid onto said at least one channel structure to flush material towards said at least one outlet.

16. The washing apparatus as claimed in claim 2, wherein a dam is provided at the discharge outlet of the second screening deck.

17. The washing apparatus of claim 1, further including a vibratory drive system coupled to said screening apparatus for imparting vibratory movement to said first and second screening decks.

18. The washing apparatus of claim 17, wherein said vibratory drive system is configured to impart vibratory movement to said first and second screening decks that moves material on the respective screens in a direction from the respective feed inlet to the respective discharge outlet.

19. A washing system comprising a washing apparatus as claimed in claim 1, wherein the washing system further comprises conveying means for conveying material that passes through said first screening deck to said second screening deck, and wherein said washing system includes a sump for receiving material that passes through the first screening deck, and wherein said conveying means is configured to convey material from said sump, and wherein said conveying means comprises either one or both of:

a pump system comprising at least one pump and at least one conduit; and a liquid-solid separating device, and wherein said washing system includes feeding means arranged to feed material to the first screening deck.

20. A washing system comprising:

a washing apparatus for washing particulate material, the washing apparatus comprising:

a screening apparatus having a first screening deck configured to pass material of up to a first particle size, and a second screening deck configured to pass material of up to a second particle size wherein said first particle size is larger than said second particle size such that said first screening deck is configured to pass material larger than said second particle size; and a liquid delivery system configured to deliver liquid onto the first screening deck, wherein the second screening deck is located above the first screening deck, and wherein the screening apparatus has a feed inlet for feeding material to be washed to said first screening deck;

conveying means configured to convey material that passes through said first screening deck to said second screening deck; and feeding means configured to feed said material to be washed to said feed inlet.

* * * * *